US008020845B2

(12) United States Patent
Dawley

(10) Patent No.: US 8,020,845 B2
(45) Date of Patent: Sep. 20, 2011

(54) SINGLE LEVEL WEB CONVERSION APPARATUS AND METHOD

(75) Inventor: Douglas Joseph Dawley, Dover, NH (US)

(73) Assignee: Goss International Americas, Inc., Durham, NH (US)

( * ) Notice: Subject to any disclaimer, the term of this patent is extended or adjusted under 35 U.S.C. 154(b) by 266 days.

(21) Appl. No.: 12/322,775

(22) Filed: Feb. 6, 2009

(65) Prior Publication Data

US 2010/0201056 A1 Aug. 12, 2010

(51) Int. Cl.
*B41F 13/64* (2006.01)

(52) U.S. Cl. ..... 270/5.02; 270/5.01; 270/5.03; 270/10; 270/52.07; 270/52.09; 270/11; 270/12; 270/13; 270/17

(58) Field of Classification Search ..... 270/5.01, 270/5.02, 5.03, 6–17, 52.07, 52.09, 20.1, 270/21.1

See application file for complete search history.

(56) References Cited

U.S. PATENT DOCUMENTS

| | | | | | |
|---|---|---|---|---|---|
| 2,019,658 | A | | 11/1935 | Crafts | |
| 2,361,459 | A | | 10/1944 | Corbin | |
| 2,395,950 | A | | 3/1946 | Wolf | |
| 2,613,077 | A | * | 10/1952 | Smith, Jr. | 270/5.02 |
| 2,631,845 | A | | 3/1953 | Zuckerman | |
| 3,623,722 | A | | 11/1971 | Sjogren et al. | |
| 3,717,249 | A | * | 2/1973 | Faley | 209/552 |
| 3,889,939 | A | | 6/1975 | Faltin | |
| 3,915,445 | A | * | 10/1975 | Duncan et al. | 270/37 |
| 3,948,504 | A | | 4/1976 | Woessner et al. | |
| 3,964,598 | A | | 6/1976 | Alsop | |
| 4,026,537 | A | | 5/1977 | Harris | |
| 4,034,973 | A | | 7/1977 | Hams | |
| 4,050,686 | A | | 9/1977 | McCain et al. | |
| 4,279,410 | A | | 7/1981 | Bolza-Schunemann | |
| 4,466,603 | A | | 8/1984 | Schnell | |
| 4,533,132 | A | | 8/1985 | Wangermann | |
| 4,534,552 | A | | 8/1985 | Rahe | |
| 4,545,782 | A | * | 10/1985 | Niemiro et al. | 493/425 |
| 4,593,893 | A | | 6/1986 | Suter | |
| 4,729,282 | A | | 3/1988 | Kasdorf | |
| 4,919,027 | A | | 4/1990 | Littleton | |
| 5,014,975 | A | | 5/1991 | Hamricke | |
| 5,080,338 | A | | 1/1992 | Belanger et al. | |
| 5,098,075 | A | | 3/1992 | Lindblom | |

(Continued)

OTHER PUBLICATIONS

Vits-Multicut HP Servo Drive Sheeter; http://www.vits.com/index_en.php?level=3&CatID=3.13.16.49&inhalt_id=47 (accessed Feb. 4, 2009).

(Continued)

*Primary Examiner* — Leslie A Nicholson, III
(74) *Attorney, Agent, or Firm* — Davidson, Davidson & Kappel, LLC

(57) ABSTRACT

A single level web conversion apparatus is provided. The single level web conversion apparatus includes a web guiding apparatus guiding a web, a former longitudinally folding the web downstream of the web guiding apparatus and a cutting apparatus cutting the folded web into a first signature and a second signature. The web guiding apparatus includes rolls having axes of rotation aligned with a vertical direction that guide the web in a vertical on-edge orientation. The former receives the web in a vertical on-edge orientation and folding the web such that the folded web has a horizontal orientation and travels in a horizontal plane. The first and second signature each travel in the horizontal plane. A method of producing and delivering printed products is also provided.

14 Claims, 4 Drawing Sheets

U.S. PATENT DOCUMENTS

| | | | | |
|---|---|---|---|---|
| 5,176,371 | A * | 1/1993 | Rau et al. | 270/42 |
| 5,293,797 | A | 3/1994 | Spalding et al. | |
| 5,354,047 | A | 10/1994 | Chesnutt et al. | |
| 5,405,127 | A | 4/1995 | Welborn | |
| 5,439,206 | A | 8/1995 | Raasch et al. | |
| 5,522,586 | A | 6/1996 | Bennett et al. | |
| 5,538,242 | A | 7/1996 | Doucet | |
| 5,542,547 | A | 8/1996 | Ricciardi | |
| 5,707,054 | A | 1/1998 | Loquet et al. | |
| 6,062,372 | A | 5/2000 | Cote et al. | |
| 6,231,044 | B1 | 5/2001 | Neary et al. | |
| 6,341,773 | B1 | 1/2002 | Aprato et al. | |
| 6,360,640 | B1 | 3/2002 | Cote | |
| 6,439,562 | B1 | 8/2002 | Cote et al. | |
| 6,443,449 | B1 | 9/2002 | Takagi et al. | |
| 6,572,097 | B2 | 6/2003 | d'Agrella et al. | |
| 6,588,739 | B1 | 7/2003 | Weis | |
| 6,684,746 | B2 | 2/2004 | Hilliard et al. | |
| 7,621,857 | B2 | 11/2009 | Pompile | |
| 2001/0022421 | A1 | 9/2001 | Schaefer et al. | |
| 2004/0060464 | A1 | 4/2004 | Birkenfeld et al. | |
| 2004/0135303 | A1 | 7/2004 | Weiler | |
| 2005/0124481 | A1 | 6/2005 | D'Agrella et al. | |
| 2006/0144507 | A1 | 7/2006 | Herbert et al. | |
| 2006/0180438 | A1 | 8/2006 | Mosli et al. | |
| 2007/0062392 | A1 | 3/2007 | Ratz | |
| 2007/0068408 | A1 | 3/2007 | Christmann et al. | |
| 2008/0112743 | A1 | 5/2008 | Moore | |
| 2008/0128983 | A1 | 6/2008 | Prim et al. | |
| 2008/0190309 | A1 | 8/2008 | Rancourt et al. | |
| 2009/0127763 | A1 | 5/2009 | Cossette | |
| 2010/0201058 | A1 | 8/2010 | Dawley et al. | |
| 2010/0201065 | A1 | 8/2010 | Dawley et al. | |
| 2010/0201066 | A1 | 8/2010 | Dawley | |

OTHER PUBLICATIONS

Vits Rotocut S; http://www.vits.com/index_en.php?level=3&CatID=3.13.16.49&inhalt_id=43 (accessed Feb. 4, 2009).

Vits Rotocut HS; http://www.vits.com/index_en.php?level=3&CatID=3.13.16.49&inhalt_id=44# (accessed Feb. 4, 2009).

Innotech High Speed Sheeters; http://www.innotechequip.com/sheeter.htm (accessed Feb. 4, 2009).

Innotech Finishing Line Equipment; http://www.innotechequin.com/finishing.htm (accessed Feb. 4, 2009).

Goss International; M-600 Folia: High Productivity Perfecting Press; 2008 (accessed from http://www.gossinternational.com/clientuploads/folia/downloads.htm, on Feb. 5, 2009).

Goss International; M-600: 16-Page Web Offset Press Systems; Aug. 5, 2008 (accessed from http://gossinternational.com/index.php?src=gendocs&ref=m600&category=en_Products, on Feb. 5, 2009).

Manroland; Roland 900: Printing Units, Dimensions and Details; http://www.manroland.com/com/pdf_en/MR_ROLAND_900_Datenblatt_e.pdf (accessed Feb. 5, 2009).

Manroland; Nothing Can Replace Capacity: The Roland 900; http://www.manroland.com/com/pdf_en/MR_ROLAND_900_Broschuere_e.pdf (accessed Feb. 5, 2009).

U.S.P.T.O. Office Action in U.S. Appl. No. 12/322,738 (Pub. 2010/0201065) dated Sep. 15, 2010.

U.S.P.T.O. Office Action in U.S. Appl. No. 12/322,767 (Pub. 2010/0201058) dated Sep. 14, 2010.

U.S.P.T.O. Office Action in U.S. Appl. No. 12/322,768 (Pub. 2010/0201066) dated Sep. 15, 2010.

* cited by examiner

SINGLE LEVEL WEB CONVERSION APPARATUS AND METHOD

The present invention relates generally to printing presses, and more particularly to a web conversion apparatus for a web printing press.

BACKGROUND OF THE INVENTION

In the web offset printing process, a continuous web of paper is transported through a printing press. Near the beginning of the press, one or more printing units apply ink to the web to repeatedly create a pattern, or impression, of text and images. At the end of the press, a web conversion apparatus, such as a sheeter or folder, may be used to convert a web into individual products.

A sheeter converts a continuous web of material into individual sheets of material. Typcially, a sheeter produces a single sheet of paper that will be used for a poster, book cover or be subsequently processed. Sheeters are known for example from the firm Innotech, which is located in Valley Cottage, N.Y. Innotech manufactures web press auxiliary equipment, including some equipment that involves transporting webs on-edge.

A folder converts a continuous web of material into individual folded products. In a typical folder, the web and signatures travel a considerable distance in the vertical direction. To accommodate this vertical travel, folders are often quite tall, with some exceeding 35 feet in height. A tall folder requires a printing press facility with high ceilings. A tall folder is also more difficult to operate because reaching the various apparatus components requires climbing up and down many stairs. To reduce the height of folders, back-to-back formers and side-by-side formers have been employed.

SUMMARY OF THE INVENTION

A single level web conversion apparatus is provided. The single level web conversion apparatus includes a web guiding apparatus guiding a web, a former longitudinally folding the web downstream of the web guiding apparatus and a cutting apparatus cutting the folded web into a plurality of successive signatures. The web guiding apparatus includes rolls having axes of rotation aligned with a vertical direction that guide the web in a vertical on-edge orientation. The former receives the web in a vertical on-edge orientation and folding the web such that the folded web has a horizontal orientation and travels in a horizontal plane. Each of the plurality of successive signatures travel in the horizontal plane.

A method of producing and delivering printed products is also provided. The method includes the steps of redirecting a web with angle bars so the web travels horizontally in an on-edge vertical orientation; guiding the web with rolls having axes of rotation aligned with a vertical direction; folding the web with a former such that the web enters the former traveling horizontally in the on-edge vertical orientation and exits the former traveling horizontally in a horizontal orientation; cutting the web with a cutting apparatus to create signatures; and transporting the signatures away from the cutting apparatus in the horizontal direction.

BRIEF DESCRIPTION OF THE DRAWINGS

The present invention is described below by reference to the following drawings, in which.

DETAILED DESCRIPTION

Figure 1:
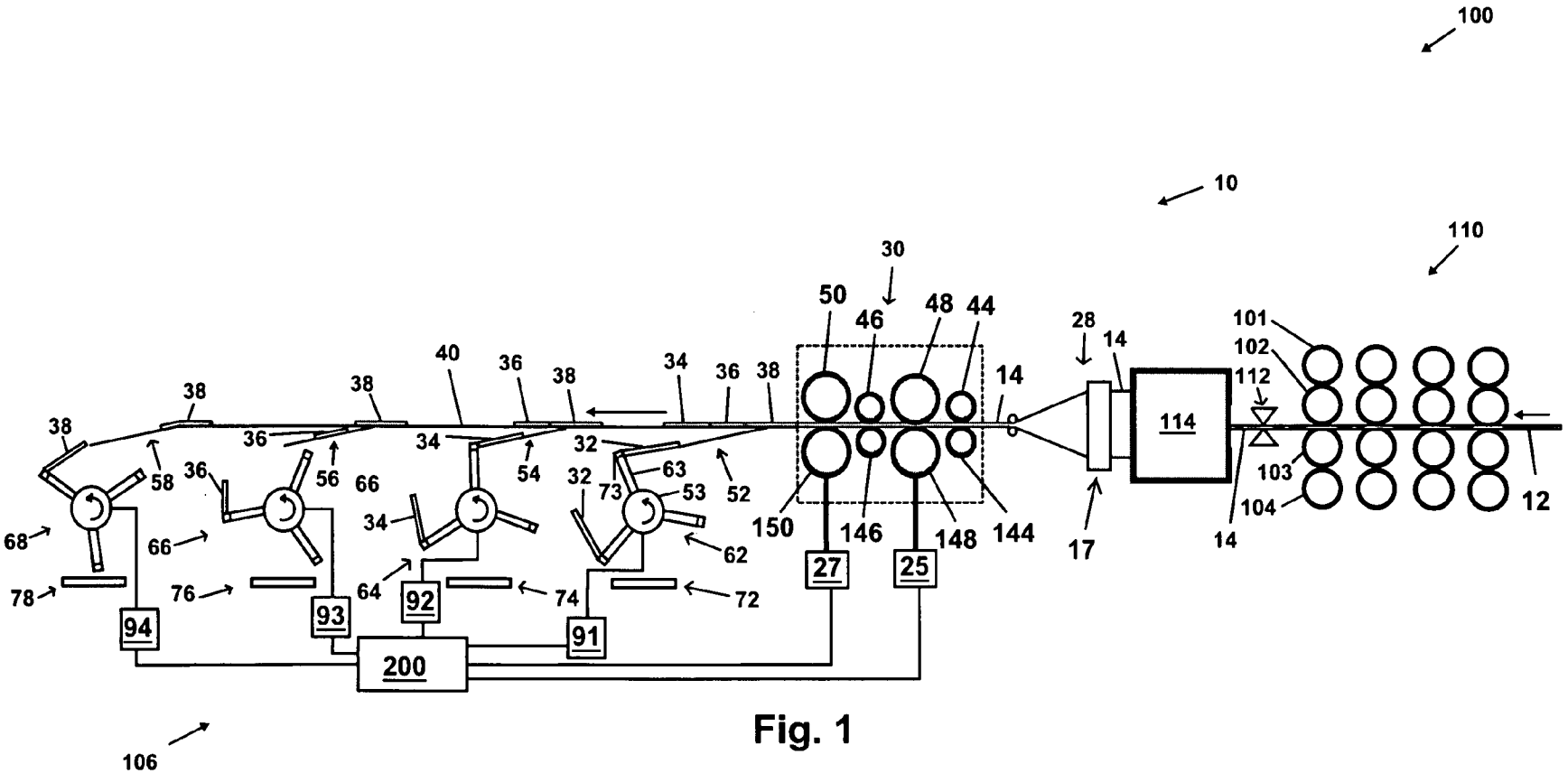
FIG. 1 shows a schematic side view of a printing press including a web-conversion apparatus according to an embodiment of the present invention.

FIG. 1 shows a schematic side view of a printing press 100 including a web-conversion apparatus 10 according to an embodiment of the present invention. Printing units 110, each including an upper plate cylinder 101, an upper blanket cylinder 102, a lower blanket cylinder 103 and a lower plate cylinder 104, act together to print four color images on a web 12. The term image used herein includes text, graphics or printed indicia on web 12, with each image have a length equal to a circumferential printing length of each plate cylinder 101, 104 and including contents of a number of pages of final printed products produced by printing press 100. After images are printed on web 12, web 12 passes through a slitter 112, which longitudinally slits web 12 into a plurality of ribbons 14. A ribbon guiding section 114 may then turn and offset ribbons 14 so ribbons 14 are vertically aligned and traveling in a horizontal plane as ribbons 14 pass through vertically aligned nip rolls 17 and enter a former 28. Former 28 imparts a longitudinal fold upon ribbons 14 such that ribbons 14 are horizontally aligned and traveling substantially in the same horizontal plane as ribbons exit former 28. Ribbons 14 may also be slit over former 28 to yield twice as many unfolded ribbons 14. Web 12 and ribbons 14 may travel at a velocity V1.

Once longitudinally folded, ribbons 14 are cut by a cutting assembly 30 into successive intermediate printed products or signatures 32, 34, 36, 38. Cutting assembly 30 may include cut cylinders 48, 50 interacting with respective anvil cylinders 148, 150 to create signatures 32, 34, 36, 38. Cut cylinder 48 may include one or more knives that are segmented and partially cut, or perforate, ribbons 14 by contacting anvils on anvil cylinder 148. Uncut portions of ribbons 14 remain in between the perforations created by cut cylinder 48. Cut cylinder 50 may include knives that cut the uncut portions of ribbons 14 and finish the partial cuts created by knives of cut cylinder 48, forming signatures 32, 34, 36, 38, by contacting anvils on anvil cylinder 150. Knives on cut cylinder 50 may also be segmented in a manner that allows uncut portions of ribbons 14 to be cut. Cutting assembly 30 may include a first pair of nip rollers 44, 144, and a second pair of nip cylinders 46, 146. Nip rollers 44, 144, 46, 146 deliver ribbons 14 to cut cylinder 48 where knife blades perforate ribbons 42 with a first cut. The process of partially cutting ribbons with cut cylinder 48 and finishing the cut with cut cylinder 50 may be referred to as a double cut. In another embodiment, ribbons 14 may also be cut completely by cut cylinder 50 and anvil cylinder 150, making the perforation by cut cylinder 48 and anvil cylinder 148 unnecessary.

In this embodiment, printing units 110 print successive four-color images on both sides of web 12, each image being aligned with an image on the opposite side of web 12. Each image includes the contents of 32 pages of final printed products produced from the image, so that a length of web 12 with an image on both sides includes the contents of 64 pages of the final printed products. Cutting assembly 40 forms four individual signatures 32, 34, 36, 38 from each image printed on web 12 by printing units 110, with each signature including 16 pages (8 pages, printed on both front and back). For example, ribbons 14 are cut by cutting assembly 30 such that one cut by cut cylinder 50 creates a lead edge of one first signature 32, a subsequent by cut cylinder 50 creates a lead edge of one second signature 34 and a tail edge of the one first signature 32, a subsequent by cut cylinder 50 creates a lead edge of one third signature 36 and a tail edge of the one second signature 34, a subsequent by cut cylinder 50 creates a lead edge of one fourth signature 38 and a tail edge of the one third signature 36 and a subsequent by cut cylinder 50 creates a lead edge of one subsequent first signature 32 and a tail edge of the one fourth signature 38. In the embodiment where a double cut is performed, each cut by cut cylinder 50 creating edges of signatures finishes a partial cut created by cut cylinder 48. In the embodiment where only cut cylinder 50 is provided, and not cut cylinder 48, each cut by cut cylinder 50 cuts entirely through ribbons 14.

Cylinders 48, 148 may be phased with respect to cylinders 50, 150, with cylinders 48, 148 being driven by a servomotor 25 at varying velocities during each revolution and cylinders 50, 150 being driven by a servomotor 27 at varying velocities during each revolution so that printed signatures 32, 34, 36, 38 may vary in length. Servomotors 25, 27 may be controlled by a controller 200. Any combination of cutoff lengths for signatures 32, 34, 36, 38 is possible, as long as the sum of the cutoff lengths equal the length of each four-color image printed by printing units 110. For example, if plate cylinders 101, 104 and blanket cylinders 102, 103 each have a printing circumference of 44 inches and print images that are 44 inches in length on web 12, signature 32 may have a cutoff length of 15 inches, signature 34 may have a cutoff length of 10 inches, signature 36 may have a cutoff length of 11 inches and signature 38 may have a cutoff length of 8 inches.

Signatures 32, 34, 36, 38, traveling away from cutting assembly 30 enter a delivery section 106 where conveyor 40 transports signatures 32, 34, 36, 38 at a second velocity V2 away from cutting assembly 30. Velocity V2 may be greater than velocity V1. Conveyor 40 may be in the form of transport tapes, which grip a lead edge of ribbons 13 just as ribbons 14 are cut by cut cylinder 50 and positively grip signatures 32, 34, 36, 38 by contacting signatures 32, 34, 36, 38 from above and below. Guide belts may be provided to assist in guiding ribbons 14 into cutting assembly and signatures 32, 34, 36, 38 towards conveyor 40. The guide belts may be provided in circumferential cutouts spaced axially in cylinders 48, 50, 148, 150 and rolls 44, 46, 144, 146. In an alternative embodiment, the guide belts may be introduced only between cut cylinder 48 and cut cylinder 50 to control the printed product while the uncut portions of ribbons 14 are cut by cut cylinder 50.

Signatures 32, 34, 36, 38 are diverted from conveyor 40 by respective diverter assemblies 52, 54, 56, 58. Diverter assemblies 52, 54, 56, 58 force respective signatures 32, 34, 36, 38 out of the path of conveyor 40 and down to respective deceleration assemblies 62, 64, 66, 68.

A first diverter assembly 52 removes signatures 32 from conveyor 40 and transports signatures 32 to a first deceleration assembly 62. First deceleration assembly 62, rotating about a first axis that is perpendicular to the direction of travel of conveyor 40, grips signatures 32 and delivers signatures 32 to first delivery section 72. First delivery section 72, which may be a conveyor running axially with respect to deceleration assembly 62 in a second horizontal plane below the horizontal plane of conveyor 40, carries signatures 32 away from deceleration assembly 62.

Signatures 34, 36, 38 are transported by conveyor 40 past first diverter assembly 52. A second diverter assembly 54 removes signatures 34 from conveyor 40 and transports signatures 34 to a second deceleration assembly 64. Second deceleration assembly 64, rotating about a second axis that is perpendicular to the direction of travel of conveyor 40, grips signatures 34 and delivers signatures 34 to second delivery section 74. Second delivery section 74, which may be a conveyor running axially with respect to deceleration assembly 64 in the second horizontal plane below the horizontal plane of conveyor 40, carries signatures 34 away from deceleration assembly 64.

Signatures 36, 38 are transported by conveyor 40 past second diverter assembly 54. A third diverter assembly 56 removes signatures 36 from conveyor 40 and transports signatures 36 to a third deceleration assembly 66. Third deceleration assembly 66, rotating about a third axis that is perpendicular to the direction of travel of conveyor 40, grips signatures 36 and delivers signatures 36 to third delivery section 76. Third delivery section 76, which may be a conveyor running axially with respect to deceleration assembly 66 in the second horizontal plane below the horizontal plane of conveyor 40, carries signatures 36 away from deceleration assembly 66.

Signatures 38 are transported by conveyor 40 past third diverter assembly 56. A fourth diverter assembly 58 removes signatures 38 from conveyor 40 and transports signatures 38 to a fourth deceleration assembly 68. Fourth deceleration assembly 68, rotating about a fourth axis that is perpendicular to the direction of travel of conveyor 40, grips signatures 38 and delivers signatures 38 to fourth delivery section 78. Fourth delivery section 78, which may be a conveyor running axially with respect to deceleration assembly 68 in the second horizontal plane below the horizontal plane of conveyor 40, carries signatures 38 away from deceleration assembly 68. In an alternative embodiment, fourth diverter assembly 58 is not necessary, and conveyor 40 may transport signatures 38 directly to fourth deceleration assembly 68.

Signatures 32, 34, 36, 38 may be transported by respective delivery sections 72, 74, 76, 78 at a velocity V3, which may be less than velocity V2, to downstream finishing operations.

Each deceleration assembly 62, 64, 66, 68 may include a center body 53, arms 63, and grippers 73, respectively. Arms 63 protrude radially from center bodies 53 and grippers 73, which are configured to engage signatures 32, 34, 36, 38, are positioned at ends of arms 63.

Figure 2:
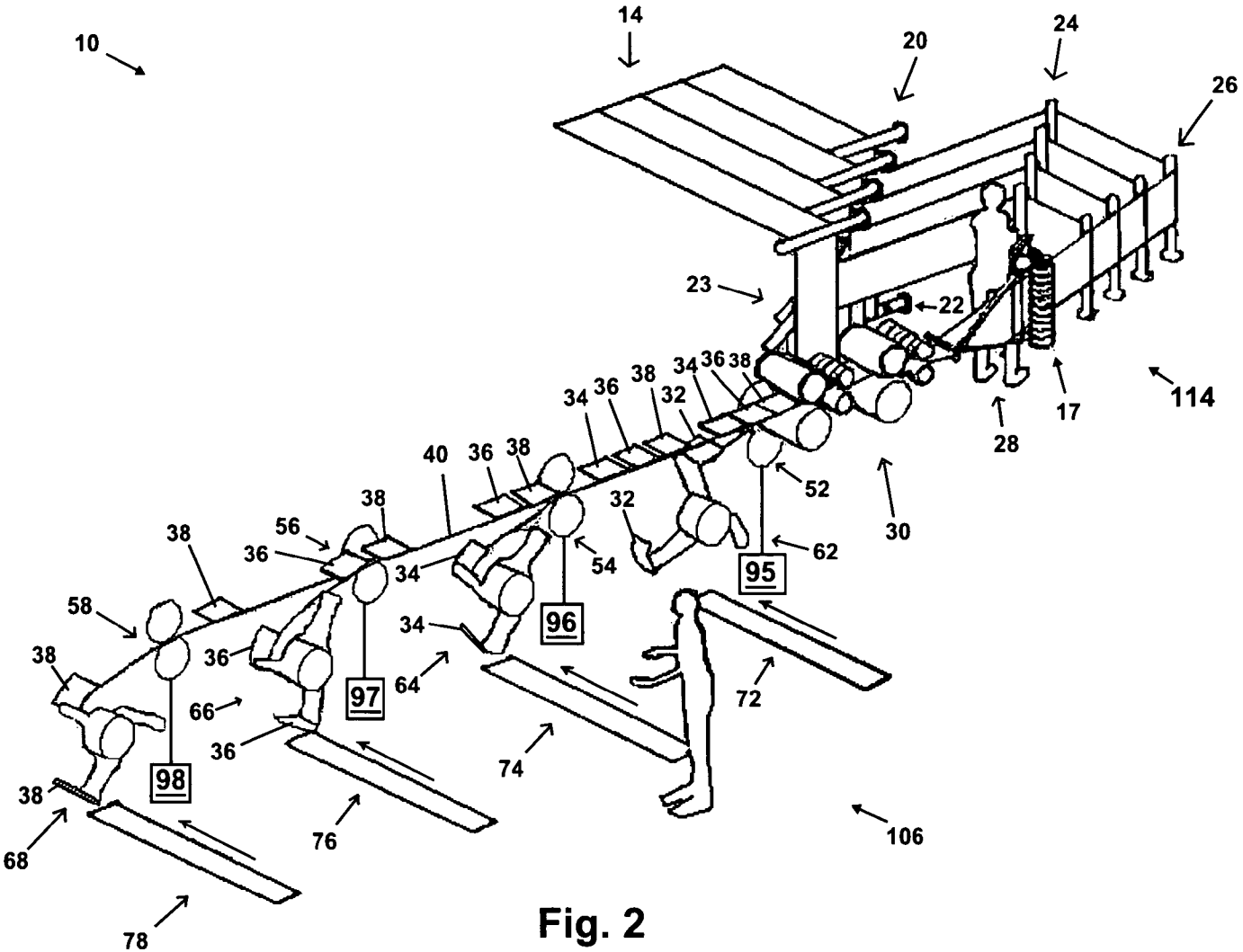
FIG. 2 shows a perspective view of the web-conversion apparatus shown in FIG. 1.

Diverting assemblies 52, 54, 56, 58 and deceleration assemblies 62, 64, 66, 68 are phased so that diverting assemblies remove respective signatures 32, 34, 36, 38 from conveyor 40 in a proper orientation and arms 63 of deceleration assemblies 62, 64, 66, 68 are in proper positions to receives signatures 32, 34, 36, 38 from diverting assemblies 52, 54, 56, 58, respectively. Deceleration assemblies 62, 64, 66, 68 may driven by respective motors 91, 92, 93, 94, and diverting assemblies may be driven by respective motors 95, 96, 97, 98 (FIG. 2). Motors 91, 92, 93, 94, 95, 96, 97, 98 may be servomotors and may be controlled by controller 200 to ensure proper phasing.

In alternative embodiments, cutting assembly 30 may be configured to cut each image into a different number of signatures, for example three. The number of delivery assemblies, deceleration assemblies and delivery sections may be adjusted to match the maximum number of signatures produced by cutting assembly 30. Web conversion apparatus 10 may be adjusted to accommodate three signatures from one image by inactivating diverting assembly 58 and deceleration assembly 68 and rephrasing diverting assemblies 52, 54, 56 and deceleration assemblies 62, 64, 66.

In other embodiments, web conversion and delivery apparatus 10 may be configured such that web 12 is not slit into ribbons 14 and/or web 12 is not folded longitudinally by former 28. The term web as used herein is defined such that web may also include ribbons.

FIG. 2 shows a perspective view of web conversion apparatus 10 from FIG. 1. Web conversion apparatus 10 includes ribbon guiding section 114, cutting assembly 30, former 28 and delivery section 106. Ribbons 14 enter web-conversion apparatus 10 and are converted into multiple signatures 32, 34, 36, 38, which may form individual final printed products.

Figure 3:
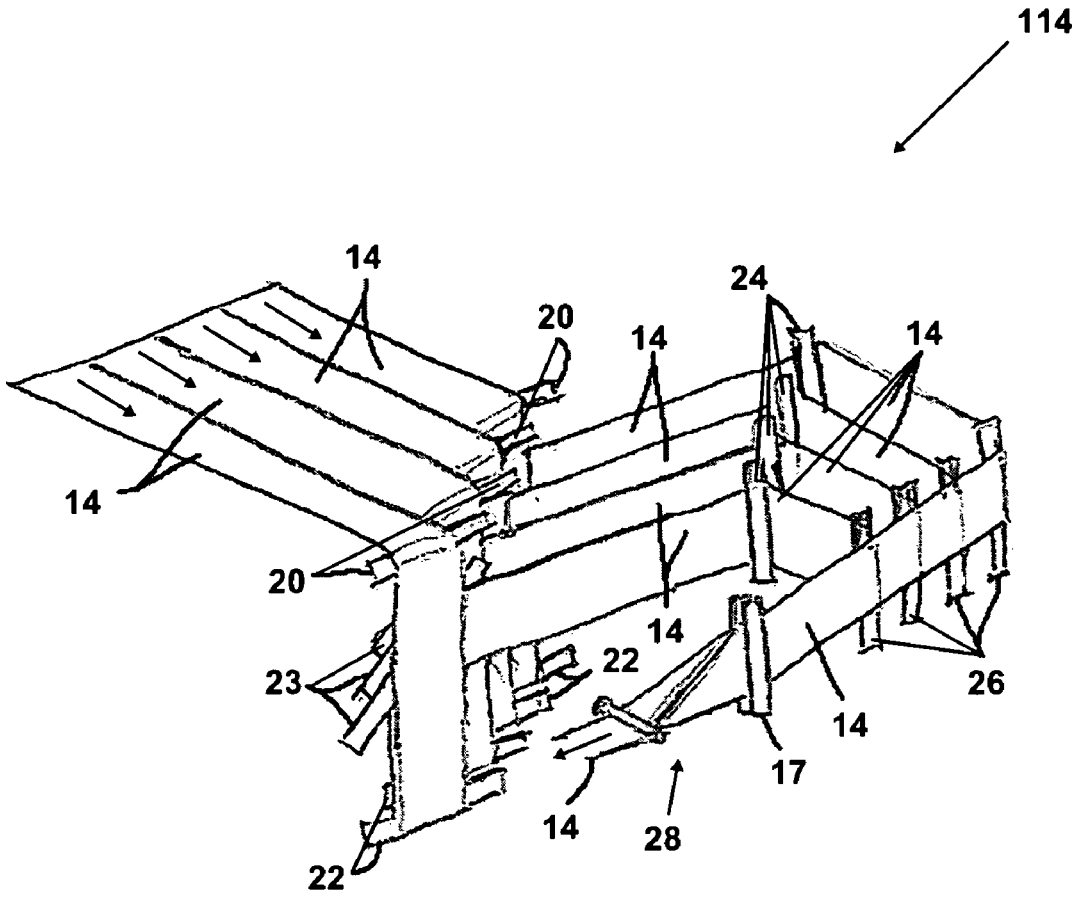
FIG. 3 shows an enlarged perspective view of a ribbon guiding section of the web-conversion apparatus shown in FIG. 2.

Ribbon guiding section 114, which is shown more clearly in FIG. 3, includes lead rolls 20, 24, compensators 22, angle bars 23 and pull rolls 26. Ribbons 14 are wrapped around and redirected by lead rolls 20, 24, compensators 22, angle bars 23 and pull rolls 26 to ensure ribbons 14 are properly oriented as they enter former 28. Ribbons 14 enter ribbon guiding section 114 traveling substantially horizontal and are guided vertically by lead rolls 20 and compensators 22. Angle bars 23 redirect ribbons 14 so that ribbons 14 are transported horizontally, in an upright on-edge orientation, such that ribbons 14 are aligned as required vertically. Lead rolls 24 and pull rolls 26 can change the horizontal direction of travel of ribbons 14, while maintaining the upright on-edge orientation of ribbons 14. The axes of rotation of pull rolls 26, lead rolls 24, and nip rolls 17 are aligned with the vertical direction, allowing ribbons 14 to transported horizontally into former 28. Ribbons 14 are merged on-edge after pull rolls 26. Ribbons 14 pass between nip rolls 17 and are longitudinally folded by former 28.

Ribbons 14, once longitudinally folded, are aligned with the horizontal direction so that ribbons 14 are no longer oriented on-edge but instead are aligned substantially in the horizontal plane. Ribbons 14 are then cut by a cutting assembly 30 into four successive signatures 32, 34, 36, 38. Cylinders 48, 50, 148, 150 of cutting assembly 30 are rotated at appropriate frequencies so that knives on cut cylinders 48, 50 create signatures 32, 34, 36, 38 having desired lengths. Signatures 32, 34, 36, 38, having a horizontal orientation, are transported in the horizontal direction to respective diverting assemblies 52, 54, 56, 58, which alter the path of signatures and pass signatures 32, 34, 36, 38 to respective deceleration assemblies 62, 64, 66, 68, located below conveyor 40. Deceleration assemblies 62, 64, 66, 68, rotating about axes that are perpendicular to the horizontal direction that conveyor 40 transports signatures 32, 34, 36, 38, grip respective signatures 32, 34, 36, 38, and rotate signatures 32, 34, 36, 38 approximately 180 degrees with respect to the axes of deceleration assemblies 62, 64, 66, 68, respectively. Deceleration assemblies 62, 64, 66, 68 then release signatures 32, 34, 36, 38, now traveling in a direction opposite the transport direction of conveyor 40, to respective delivery assemblies 72, 74, 76, 78, which may carry signatures 32, 34, 36, 38 away from respective deceleration assemblies 62, 64, 66, 68 in a direction that is parallel to axes of respective deceleration assemblies 62, 64, 66, 68.

The present invention can be appreciated as delivering multiple cut-offs on multiple deliveries. A single group of ribbons may be converted into multiple printed products. For example, a strip of ribbons corresponding to the once-around circumferential printing length of each of the plate cylinders of the printing press may be converted in four different print products of four different lengths. Also, not all deceleration assemblies and delivery assemblies need to be active at the same time, so two printed products could be delivered by two deceleration and two delivery assemblies and two deceleration and two delivery assemblies could be inactive.

By transporting ribbons 14, and signatures 32, 34, 36, 38 primarily in the horizontal direction, the height of web conversion and delivery apparatus 10 is advantageously reduced. The reduced height may lower the ceiling height requirements of printing press facilities and decrease the need for press personnel to climb stairs to reach the various apparatus components. Since web conversion and delivery apparatus 10 can be operated from one level, web conversion and delivery apparatus 10 may thus be easier to operate. In one embodiment, e.g. the embodiment shown in FIGS. 1 and 2, web conversion and delivery apparatus 10 may be 38 feet long and 8 feet high. In another embodiment, a web conversion and delivery apparatus may be 54 feet long and 8 feet high and receive eight ribbons and create and deliver six different signatures.

In other embodiments, a second web may be printed by a second set of printing units, slit into ribbons by a second slitter and combined with ribbons 14 to create a ribbon bundle with an increased number of ribbons, which may be converted into signatures with an increased number of pages. Also, more or less than four ribbons 14 could be created by slitter 112 (FIG. 1) and delivered by ribbon guiding section 114. Deliveries 72, 74, 76, 78 may include grippers or other In an alternative embodiment, web conversion apparatus 10 may collate signatures 32, 34, 36, 38 and stack signatures 32, 34, 36, 38 on a collating conveyor traveling in a direction perpendicular to axes of deceleration assemblies and parallel to conveyor 40.

Figure 4:
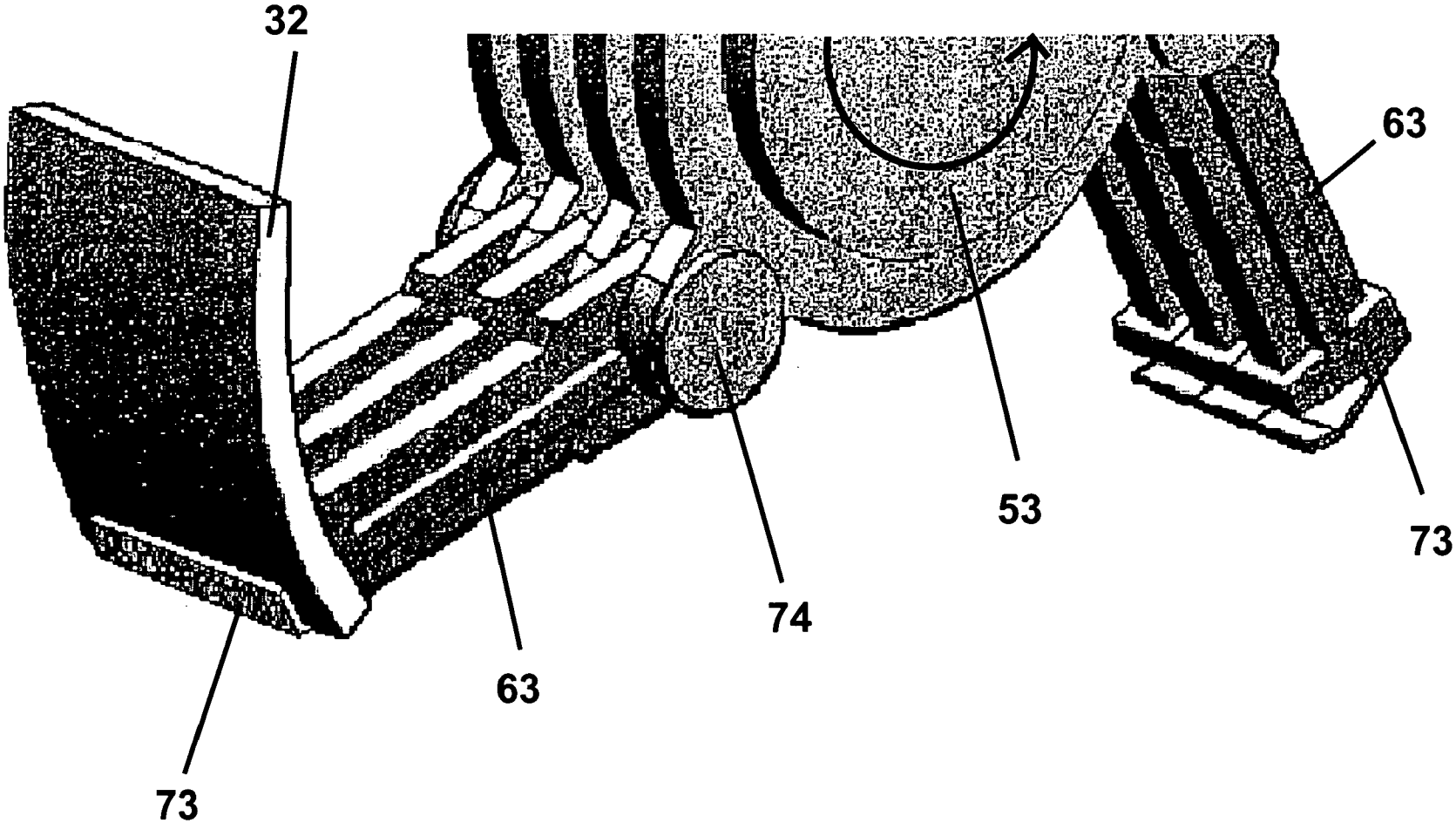
FIG. 4 shows an enlarged perspective view of a deceleration assembly shown in FIGS. 1 and 2 transporting a signature.

FIG. 4 shows an enlarged view of deceleration assembly 62 shown in FIGS. 1 and 2 transporting signature 32. Deceleration assembly 62 includes center body 53, arms 63 and grippers 73. Arms 63 are connected to 53 center body 53 by connectors 74. Grippers 73 engage signatures 32 and deliver signatures 32 to delivery assembly 72 (FIG. 2). Grippers 73 may clamp products to prevent signatures 32 from slipping out of grippers 73 or so the alignment of signatures 32 is not impaired. As deceleration assembly 62 is rotated counterclockwise about an axis of center body 53, arms 73 pass by delivery assembly 72 (FIG. 2) and grippers 73 release signatures 32 on top of delivery assembly 72. Arms 63 may be actuated about connectors 53 to ensure that grippers 73 are in appropriate positions to receive and release signatures 32.

In the preceding specification, the invention has been described with reference to specific exemplary embodiments and examples thereof. It will, however, be evident that various modifications and changes may be made thereto without departing from the broader spirit and scope of invention as set forth in the claims that follow. The specification and drawings are accordingly to be regarded in an illustrative manner rather than a restrictive sense.

What is claimed is:

1. A single level web conversion apparatus comprising:

a web guiding apparatus for guiding a web, the web guiding apparatus including at least one angle bar having an axis angled with respect to a vertical direction and a horizontal direction, the at least one angle bar redirecting the web so that the web travels in a vertical on-edge orientation in a horizontal plane, the web guiding apparatus including at least one vertical roll downstream of the at least one angle bar, the at least one vertical roll having an axis of rotation aligned with the vertical direction that guides the web in the vertical on-edge orientation;

a former for longitudinally folding the web downstream of the web guiding apparatus, the former receiving the web in a vertical on-edge orientation and folding the web such that the folded web has a horizontal orientation and travels in the horizontal plane; and a cutting apparatus for cutting the folded web into a plurality of successive signatures;

each of the plurality of successive signatures traveling in the horizontal plane;

wherein the at least one vertical roll includes at least one lead roll having an axis aligned in the vertical direction;

wherein the web guiding apparatus further includes nip rolls downstream of the lead rolls having axes aligned in the vertical direction delivering the web to the former;

wherein the at least one vertical roll includes at least one pull roll having an axis aligned in the vertical direction, the at least one pull roll being downstream of the at least one lead roll and upstream of the nip rolls.

2. The web conversion apparatus recited in claim 1 wherein the plurality of successive signatures includes a first signature and a second signature directly following the first signature.

3. The web conversion apparatus recited in claim 2 further comprising:

a first rotating assembly for gripping the first signature, the first rotating assembly altering the direction of travel of the first signature and releasing the first signature;

a second rotating assembly downstream of the first rotating assembly and for gripping the second signature, the second rotating assembly altering the direction of travel of the second signature and releasing the second signature.

4. The web conversion apparatus recited in claim 3 further comprising a transport conveyor for transporting the first signature and the second signature away from the cutting apparatus.

5. The web conversion apparatus recited in claim 4 further comprising a first diverter assembly for selectively diverting signatures from the transport conveyor, wherein the first signature is diverted by the first diverter assembly from the transport conveyor to the first rotating assembly and the second signature is not diverted by the first diverter assembly.

6. The web conversion apparatus recited in claim 5 further comprising a second diverter for selectively diverting signatures from the transport conveyor downstream from the first diverting assembly, wherein the second signature is diverted by the second diverter assembly from the transport conveyor to the second rotating assembly.

7. The web conversion apparatus recited in claim 3 further comprising a first delivery for receiving the first signature from the first rotating assembly and a second delivery for receiving the second signature from the second rotating assembly, the first delivery and the second delivery transporting the signatures in a second horizontal plane parallel to the horizontal plane.

8. The web conversion apparatus recited in claim 1 wherein the web guiding apparatus is adapted to receive the web in a horizontal orientation.

9. The web conversion apparatus recited in claim 1 wherein the web includes a plurality of ribbons, the at least one angle bar includes a plurality of angle bars, the at least one lead roll includes a plurality of lead rolls, the at least one pull roll includes a plurality of pull rolls, each angle bar guides one ribbon on edge to one of the lead rolls, each of the lead rolls guides one ribbon to one of the pull rolls and all of the ribbons are merged on-edge after the pull rolls and pass through the nip rolls.

10. The web conversion apparatus recited in claim 1 further comprising at least one compensator roll having an axis of rotation aligned with the horizontal direction, the at least one compensator roll being upstream of the at least one angle bar and guiding the web to the at least one angle bar.

11. The web conversion apparatus recited in claim 10 further comprising at least one horizontal lead roll having an axis of rotation aligned with the horizontal direction positioned above the at least one compensator roll and guiding the web downward to the at least one compensator roll.

12. A method of producing and delivering printed products comprising the steps of:

redirecting a web with at least one angle bar so the web travels horizontally in an on-edge vertical orientation, the at least one angle bar having an axis angled with respect to a vertical direction and a horizontal direction;

guiding the web with at least one vertical roll having an axis of rotation aligned with the vertical direction;

folding the web with a former such that the web enters the former traveling horizontally in the on-edge vertical orientation and exits the former traveling horizontally in a horizontal orientation;

cutting the web with a cutting apparatus to create a plurality of successive signatures; and transporting each of the signatures away from the cutting apparatus; and slitting the web into a plurality of ribbons before the redirecting step, the at least one angle bar including a plurality of angle bars, the redirecting step including redirecting each ribbon with one of the angle bars.

13. The method recited in claim 12 wherein the at least one vertical roll includes a plurality of pull rolls, the guiding step including guiding each ribbon with one of the pull rolls.

14. The method recited in claim 13 further comprising merging the ribbons and passing the ribbons through vertically aligned nip rolls after the guiding step.

* * * * *